US006286357B1

(12) United States Patent
D'Amore et al.

(10) Patent No.: US 6,286,357 B1
(45) Date of Patent: Sep. 11, 2001

(54) PROCESS FOR MANUFACTURING A SHAPED METAL CAN

(75) Inventors: Michel D'Amore, Yutz; Patrick Erhard, Sierck les Bains; François Muia, Hunting, all of (FR)

(73) Assignee: Sollac, Puteaux (FR)

( * ) Notice: Subject to any disclaimer, the term of this patent is extended or adjusted under 35 U.S.C. 154(b) by 711 days.

(21) Appl. No.: 08/618,814

(22) Filed: Mar. 20, 1996

(30) Foreign Application Priority Data

Mar. 21, 1995 (FR) ..... 95 03290

(51) Int. Cl.[7] ..... B21D 51/26
(52) U.S. Cl. ..... 72/379.4
(58) Field of Search ..... 72/367, 370, 379.4, 72/348; 413/1, 69

(56) References Cited

U.S. PATENT DOCUMENTS 1,645,971 10/1927 Riegel .

FOREIGN PATENT DOCUMENTS 517913 1/1931 (DE) .
1 900 597 2/1970 (DE) .
31 06 245 * 7/1982 (DE) ..... 413/1
0 543 695 A1 5/1993 (EP) .
WO 94/16842 8/1994 (WO) .

* cited by examiner

*Primary Examiner*—Lowell A. Larson
(74) *Attorney, Agent, or Firm*—Oblon, Spivak, McClelland, Maier & Neustadt, P.C.

(57) ABSTRACT

Process for manufacturing a shaped metal can comprising, on one hand, a bottom (1) and a peripheral wall (2) having a succession of regions of different diameters and, on the other hand, a lid crimped or seamed on the peripheral wall (2). The process comprises producing from a metal blank a cylindrical preliminary can comprising a bottom and a peripheral wall of diameter equal to a given diameter D of a region (2A) of the peripheral wall 2 of the can, effecting a necking operation on a part of the peripheral wall of the preliminary can situated above the region (2A) of the given diameter D of the peripheral wall (2) of the formed can to bring it to a diameter D1 less than the given diameter D, and effecting at least one expanding operation on a part of the peripheral wall situated above the region (2A) of the given diameter D.

14 Claims, 7 Drawing Sheets

PROCESS FOR MANUFACTURING A SHAPED METAL CAN

The present invention relates to a method for manufacturing a shaped metal can of the beverage can type and more particularly a shaped metal can comprising, on one hand, a bottom and a peripheral wall or skirt having a succession of regions of different diameters and, on the other hand, a lid crimped or seamed on the peripheral wall.

It is known to make shaped metal cans consisting of a peripheral wall having a succession of regions of different diameters, a bottom crimped or seamed on an end of the peripheral wall, and a lid crimped or seamed on the other end of said peripheral wall. This lid is provided for example with an easily opened device opened by rupture of a line of reduced strength or with a tapped neck for receiving a screwed stopper.

The peripheral wall of this type of metal can comprises a cylindrical sleeve which is welded longitudinally and expanded so as to form a succession of regions of different diameters.

Usually the peripheral wall is produced from a metal blank of soft steel having a low carbon content and a yield strength of about 250 MPa.

Such a steel permits producing without much difficulty an expansion of the welded sleeve with an expansion ratio calculated from the following formula:

$$\frac{\text{Final } D - \text{Initial } D}{\text{Initial } D} \times 100$$

which may be as much as 20%, the initial D being the initial diameter of the welded sleeve and the final D being the diameter of the welded sleeve after expansion.

To make this type of can, the welded sleeve is produced, said sleeve is expanded to obtain a peripheral wall having a succession of regions of different diameters, and a bottom and a lid are respectively crimped or seamed on each end of the sleeve.

The sleeve is usually expanded by means of a forming method employing air or nitrogen under pressure or a forming method employing an incompressible fluid.

It is also known to make a metal can of the beverage can type comprising, on one hand, a bottom and a peripheral wall in one piece with the bottom and, on the other hand, a lid crimped or seamed on the peripheral wall.

The bottom and the peripheral wall in one piece with the bottom are produced in particular by drawing and ironing a cup cut from a metal blank or strip.

For this purpose, the cup is first of all subjected to a drawing operation with a relatively large reduction on a press comprising in the conventional manner, on one hand, a fixed punch and a support constituting a peripheral blank holder which is slidable around said punch and on which the cup rests and, on the other hand, a die adapted to be applied against the cup with a force transmitted vertically by an upper slide.

The cup comprising a bottom and a flange formed by the drawing operation is then either calibrated by a light drawing operation without the use of a blank holder, or redrawn with a blank holder, and is then subjected to an ironing operation which comprises drawing the flange by means of a draw die with successive reductions so as to progressively form the peripheral wall of the can.

Thereafter, the bottom is formed on a draw die so as to impart a given geometry thereto and the neck of the peripheral wall is formed in accordance with a die-necking method with the use of a die, or in accordance with a spin-necking method employing a forming roller.

The necking method employing a die comprises in forcing the neck into a die having a conical inlet profile and a cylindrical outlet profile. A cylindrical element guides the formed wall as it leaves the die.

The force required to deform the metal is derived from the thrust applied to the bottom of the can and transmitted axially through the peripheral wall.

The spin-necking method employing a forming roller comprises driving in rotation the can which is held between a pusher and a centering ring. The profile of the neck is produced by simultaneous displacements of the rollers, the centering ring and the pusher.

This type of can is usually produced from a blank of steel having a very low carbon content.

After the drawing of the flanges of the peripheral wall, the metal is highly work hardened so that the yield strength of the peripheral wall is about 700 MPa and sometimes even exceeds this value, so that it has a practically zero expansion capability.

The possible overall expansion ratio of the peripheral wall is less than 1% and even less than 0.5% for very thin walls.

On the other hand, the advantage of such a can is that is permits obtaining very small thicknesses since the metal of the wall is a very stiff metal having high mechanical characteristics, which results in light weight and low material expenditure.

Further, such a can is produced in two parts, the bottom and the peripheral wall being in one piece, which is an advantage from the aesthetic point of view.

An object of the invention is to provide a process for manufacturing a shaped metal can, of the beverage can type, obtained for example by drawing and ironing, comprising a bottom and a peripheral wall in one piece with the bottom whereby it is possible to achieve an expansion ratio higher than 2% in the region of the peripheral wall.

The invention therefore provides a process for manufacturing a shaped metal can comprising, on one hand, a bottom and a peripheral wall including a succession of regions of different diameters and, on the other hand, a lid crimped or seamed on the peripheral wall, characterized in that it comprises:

- producing from a metal blank a cylindrical preliminary can comprising a bottom and a peripheral wall of a diameter equal to a given diameter of a region of the peripheral wall;
- effecting a necking operation on a part of the peripheral wall of the preliminary can situated above said region of said given diameter of the peripheral wall of the formed can to bring it to a diameter which is smaller than said given diameter ;
- and effecting at least one expanding operation on a part of the peripheral wall situated above said region of said given diameter for producing the succession of regions of different diameters of said peripheral wall.

According to other features of the invention:

- the process comprises, after having effected the necking operation on the part of the peripheral wall of the preliminary can situated above said region of said given diameter, effecting a single expanding operation for producing the succession of regions of different diameters of said peripheral wall.
- the diameter of the part of the peripheral wall of the preliminary can situated above said region of said given diameter is equal to the diameter of the region of the peripheral wall of the smallest diameter.

the process comprises, after having effected the necking operation on the part of the peripheral wall of the preliminary can situated above said region of said given diameter, effecting a succession of expanding and necking operations on the whole of the part of the peripheral wall of the preliminary can situated above the previously necked or expanded region.

the process comprises producing the preliminary can by drawing and ironing a metal blank of steel, aluminium or aluminium alloy.

the process comprises producing the preliminary can by drawing and redrawing a metal blank of steel, aluminium or aluminium alloy.

Features and advantages of the invention will be apparent from the following description which is given solely by way of example with reference to the accompanying drawings, in which.

Note that, in these Figures, the profile of the illustrated cans has been intentionally exaggerated for reasons of clarity.

Figure 1:
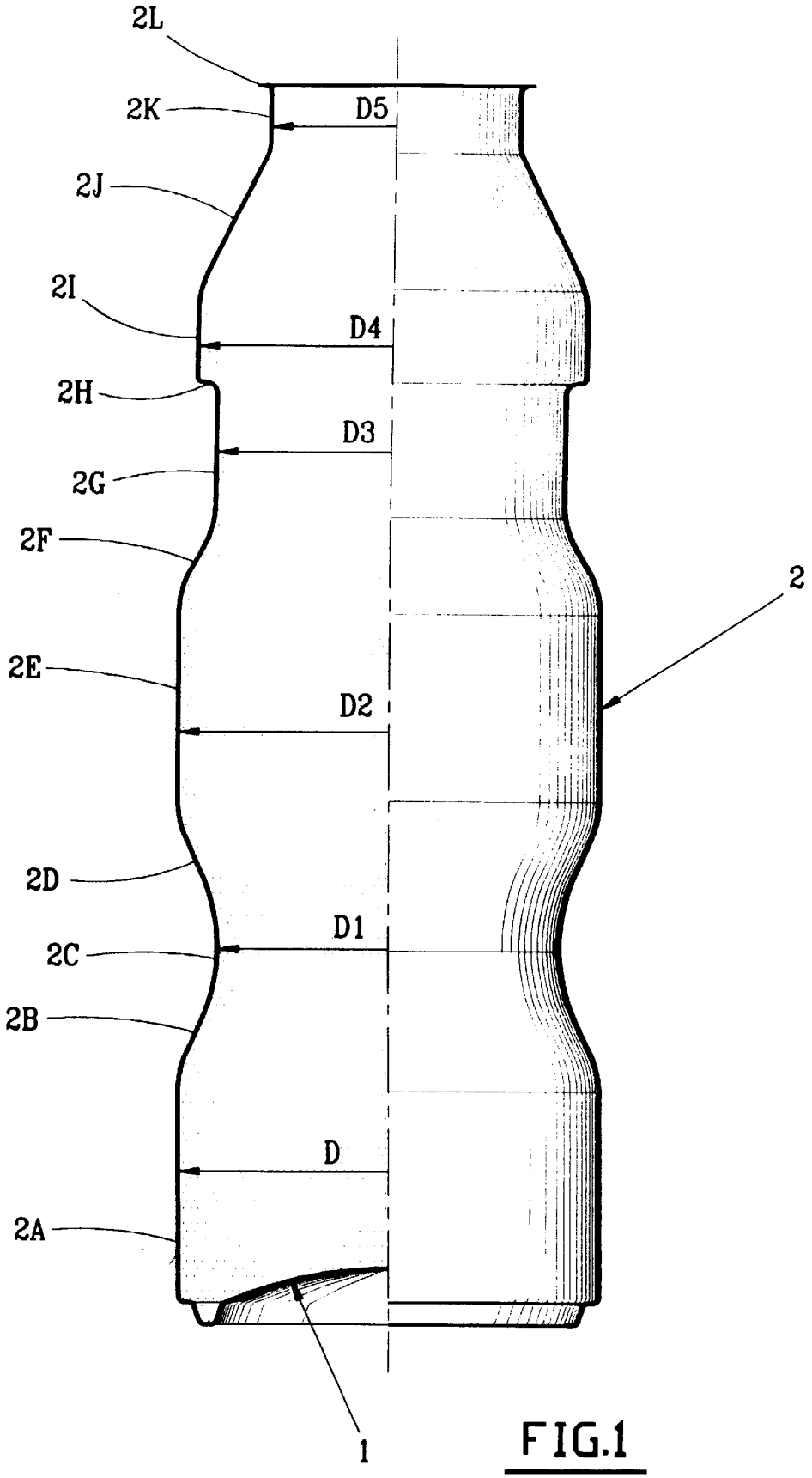
FIG. 1 is a longitudinal half-sectional and half-elevation view of a first embodiment of a shaped can obtained by the process according to the invention.

As can be seen in FIG. 1, the shaped can of the beverage can type comprises a bottom 1 and a cylindrical peripheral wall or skirt 2 in one piece with the bottom 1.

The peripheral wall 2 comprises a succession of regions of different diameters:

a region 2A adjacent the bottom 1 and of diameter D, an intermediate portion 2B which is situated above and adjacent the region 2A with respect to the bottom 1 and in which the diameter of the peripheral wall 2 decreases;

a region 2C situated above and adjacent the intermediate portion 2B and of diameter D1 which is smaller than the diameter D of the region 2A, an intermediate portion 2D situated above and adjacent the region 2C in which the diameter of the peripheral wall 2 increases, a region 2E situated above and adjacent the intermediate portion 2D and of diameter D2 larger than the diameter D1 of the region 2C;

an intermediate portion 2F which is situated above and adjacent the region 2E and in which the diameter of the peripheral wall 2 decreases, a region 2G situated above and adjacent the portion 2F and of diameter D3 smaller than the diameter D2 of the region 2E, an intermediate portion 2H which is situated above and adjacent the region 2G and in which the diameter of the peripheral wall 2 increases, a region 2I situated above and adjacent the intermediate portion 2H and of diameter D4 larger than the diameter D3 of the region 2G;

an intermediate portion 2J which is situated above and adjacent the region 2I and in which the diameter of the peripheral wall 2 decreases, this region often being termed a neck in the case of a beverage can;

a region 2K situated above and adjacent the intermediate portion 2J and of diameter D5 smaller than the diameter D4 of the region 2I, and lastly a region 2L corresponding to the flange provided for the setting, namely the crimping or seaming, of a lid (not shown) after the can has been filled.

Figure 2:
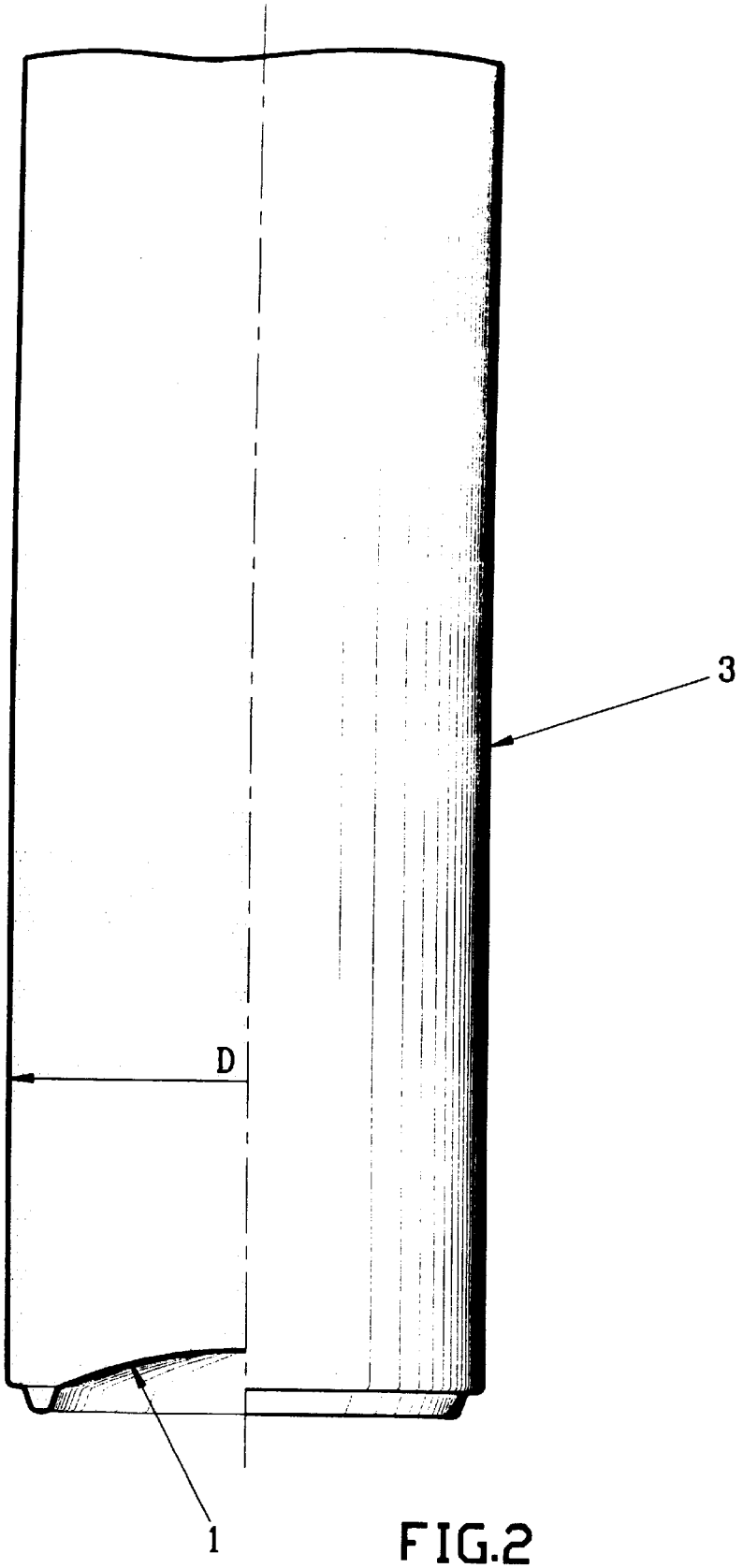
FIGS. 2 to 6 are longitudinal half-sectional and half-elevational views of the various steps of the process for manufacturing the shaped can of FIG. 1

To produce such a shaped can, the process according to the invention comprises, in a first step shown in FIG. 2, producing for example by drawing and ironing from a metal blank of steel, aluminium or aluminium alloy, a cylindrical preliminary can 3 of a diameter equal to the diameter D of the region 2A of the peripheral wall 2 adjacent the bottom 1 of the finished can of this embodiment.

When the cylindrical preliminary can 3 is produced by drawing a metal blank to form a cup and drawing or ironing the flanges of the cup, the term bottom is intended to mean the horizontal part of the preliminary can 3 which may or may not be provided with the foot and dome shown in the Figures.

In the case where the cylindrical preliminary can 3 is produced by drawing a metal blank to form a cup, redrawing the bottom of the cup to reduce the diameter of the bottom and ironing or drawing the flanges of the redrawn cup, the term bottom is intended to mean the whole of the part of the preliminary can formed in the course of the cup redrawing operation.

Figure 3:
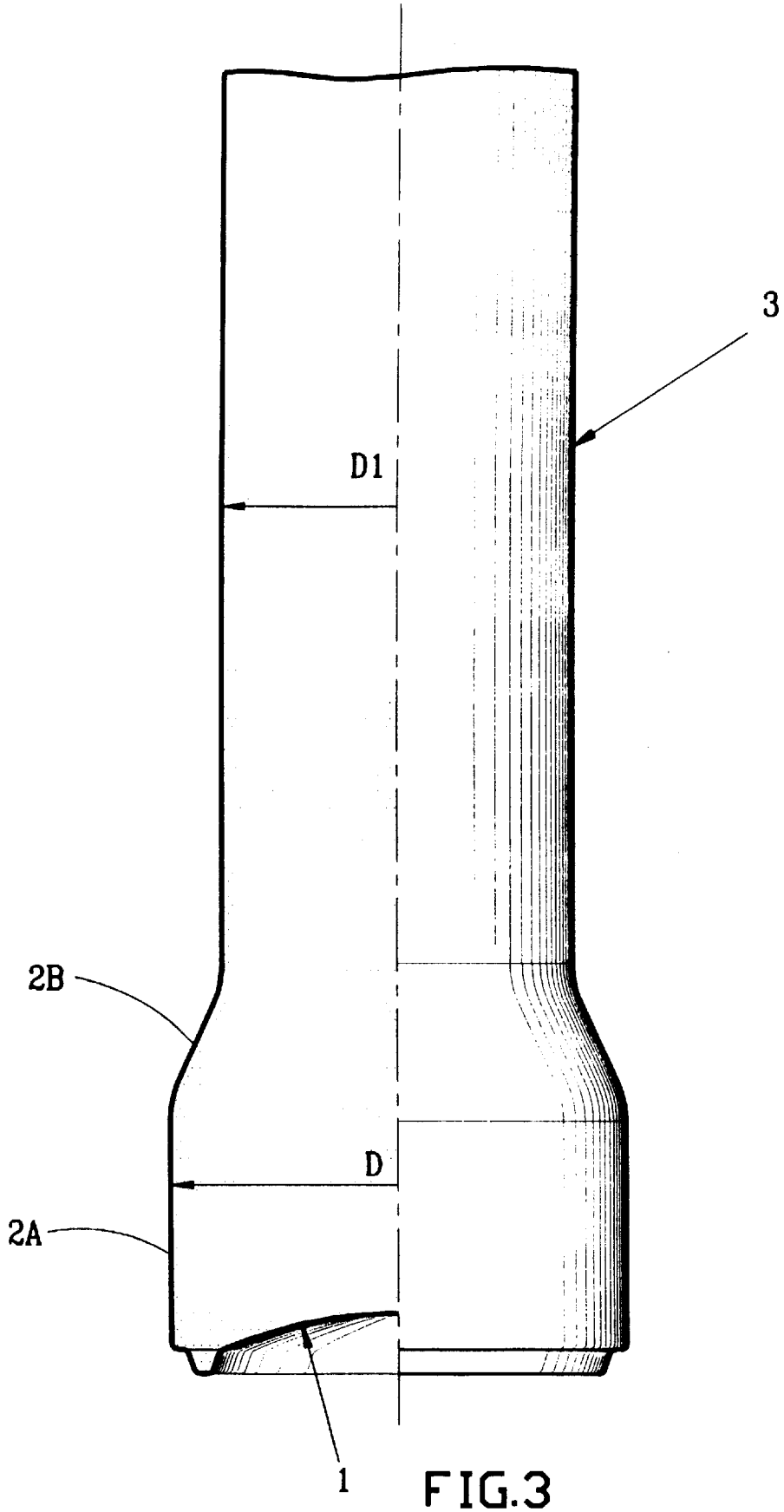

A second step shown in FIG. 3 comprises effecting a necking operation on the part of the peripheral wall of the preliminary can 3 situated above the region 2A of the peripheral wall 2 of the shaped can so as to bring it to a given diameter D1 smaller than the diameter D of the region 2A.

In this embodiment, the diameter D1 is equal to the diameter of the region 2C of the peripheral wall 2 of the shaped can.

This necking operation is carried out in a plurality of stages by means of a tool of known type comprising a die having a conical inlet profile and a cylindrical outlet profile and associated with a cylindrical element which guides the formed wall as it leaves the die.

The force required to deform the metal is derived from the thrust exerted on the bottom of the can and transmitted axially through its peripheral wall.

In order to avoid the crushing of the bottom 1 of the peripheral wall 2, compressed air at between 1 and 6 bars is supplied to the inside of the preliminary can 3 during the necking operation.

To reach the desired diameter, several successive reductions are often necessary, each one being a separate forming step.

The geometry of the various dies employed in each forming step depends on the desired profile in the intermediate portion 2B.

After this necking operation, the process according to the invention comprises effecting at least one expanding operation on the part of the peripheral wall of the preliminary can 3 situated above the region of diameter D so as to produce the succession of regions of different diameters of the peripheral wall 2 of the shaped can.

To produce the shaped can shown in FIG. 1, there is effected, after having effected the necking operation on the part of the peripheral wall of the preliminary can 3 situated above the region 2A of the formed can, a succession of expanding and necking operations on the whole of the part of the peripheral wall of the preliminary can 3 situated above the previously necked or expanded region.

Figure 4:
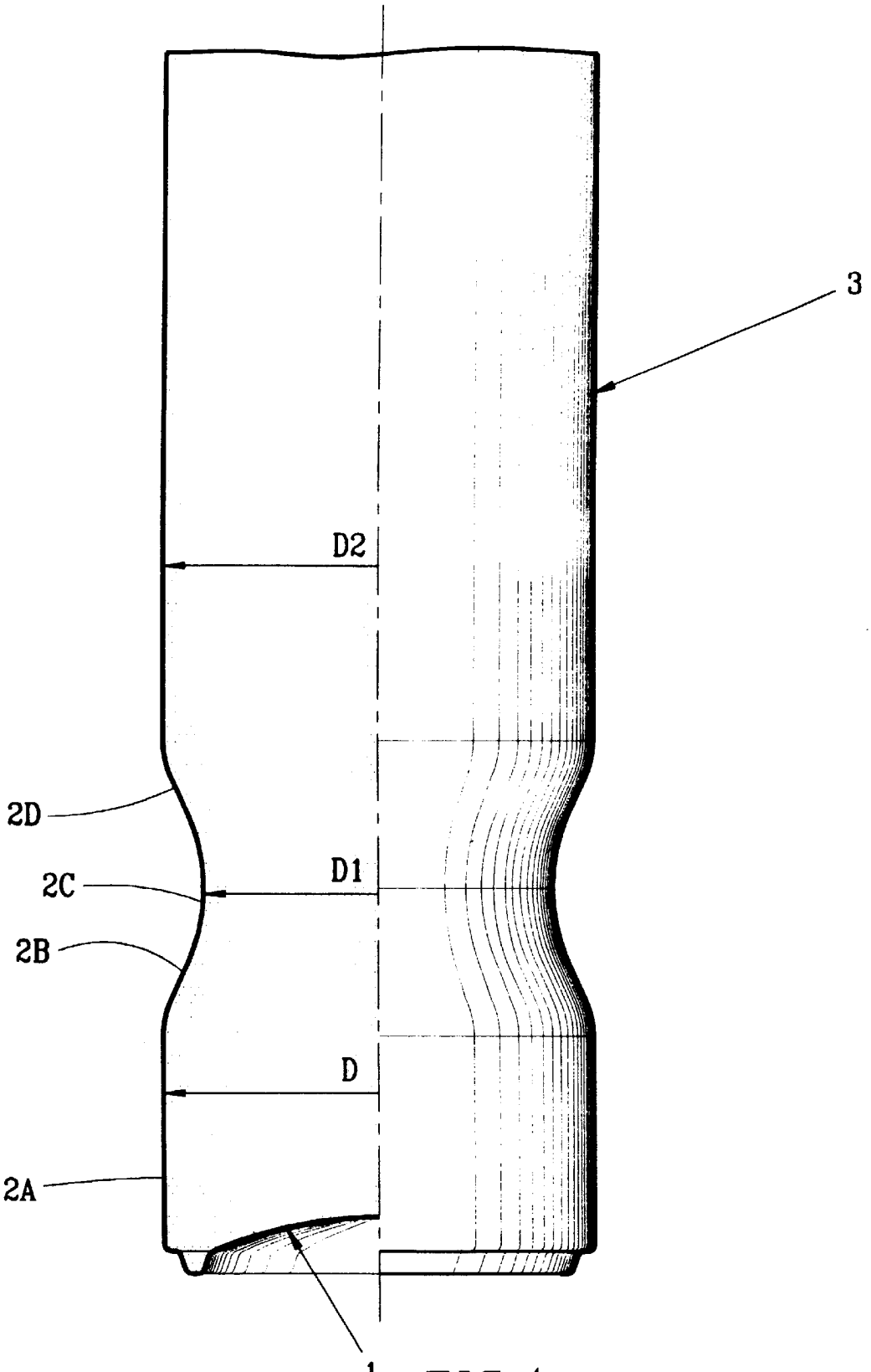

Thus, to produce the can shown in FIG. 1, the third step comprises, as shown in FIG. 4, effecting an expansion of the part of the peripheral wall of the preliminary can 3 situated above the previously necked region 2C of the peripheral wall 2 of the formed can so as to bring it to the diameter D2.

This expanding operation may be carried out in accordance with different methods.

The expanding method employing a die comprises forcing the free edge of the peripheral wall of the preliminary can 3 into a die which has a cylindrical inlet profile and a conical outlet profile and is associated with an element which guides the formed wall as it leaves the die.

To reach the desired diameter D2, a plurality of successive expansions are often required, each one being a distinct forming step.

The geometry of the different dies employed in each type of forming depends on the desired profile in the intermediate portion 2D.

The expanding method may also be a method effecting a mechanical expansion by means of a tool having sectors, or a method employing an incompressible fluid such as air, nitrogen or oil.

Figure 5:
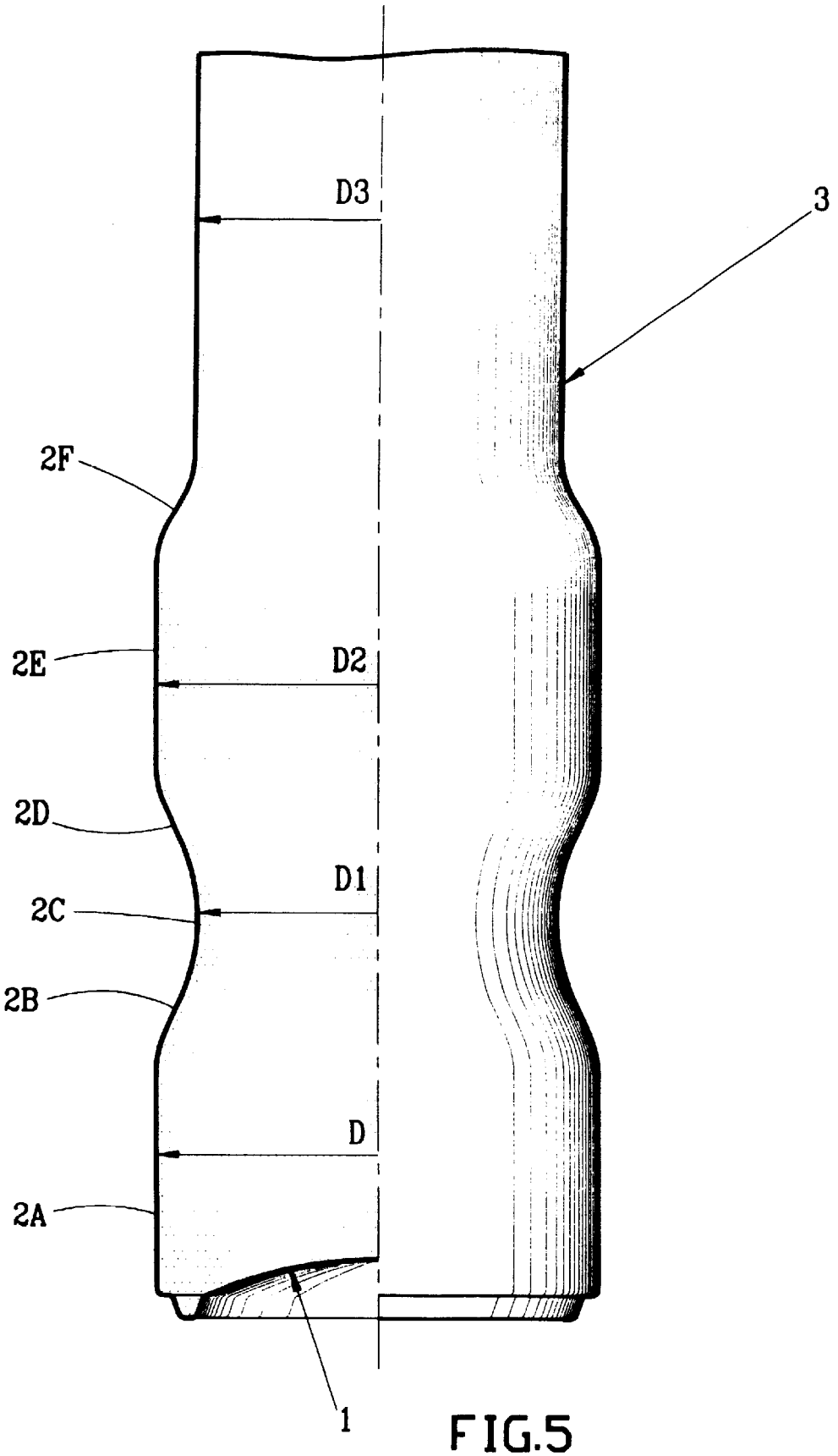

The forth step, shown in FIG. 5, comprises effecting another necking operation on the part of the peripheral wall of the preliminary can 3 situated above the previously expanded region 2E to bring it to a diameter D3 while taking care to shape the intermediate portion 2F in accordance with the desired profile.

Figure 6:
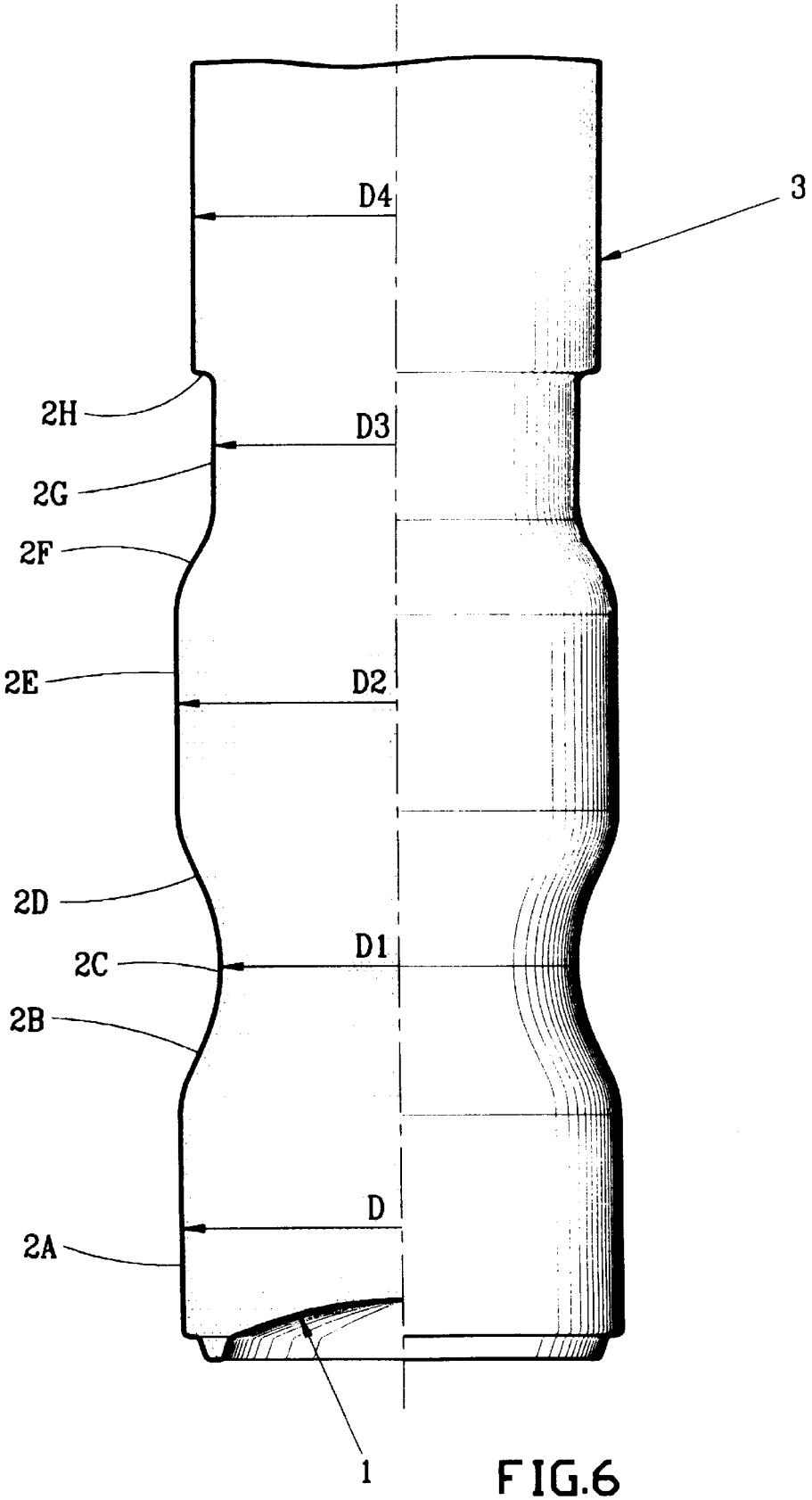

The fifth step, shown in FIG. 6, comprises effecting another expanding operation on the part of the peripheral wall of the preliminary can 3 situated above the previously necked region 2G to bring it to the diameter D4 while taking care to shape the intermediate portion 2H in accordance with the desired profile.

Lastly, the sixth step comprises effecting a last necking operation on the part of the peripheral wall of the preliminary can 3 situated above the previously expanded region 2I to bring it to the diameter D5 while taking care to shape the intermediate portion 2J in accordance with the desired profile and effect the flanging for the crimping or seaming of the lid.

The various necking and expanding operations such as those described for carrying out the third to the sixth steps employ for example the same methods as those described for carrying out the first and second steps.

Figure 7:
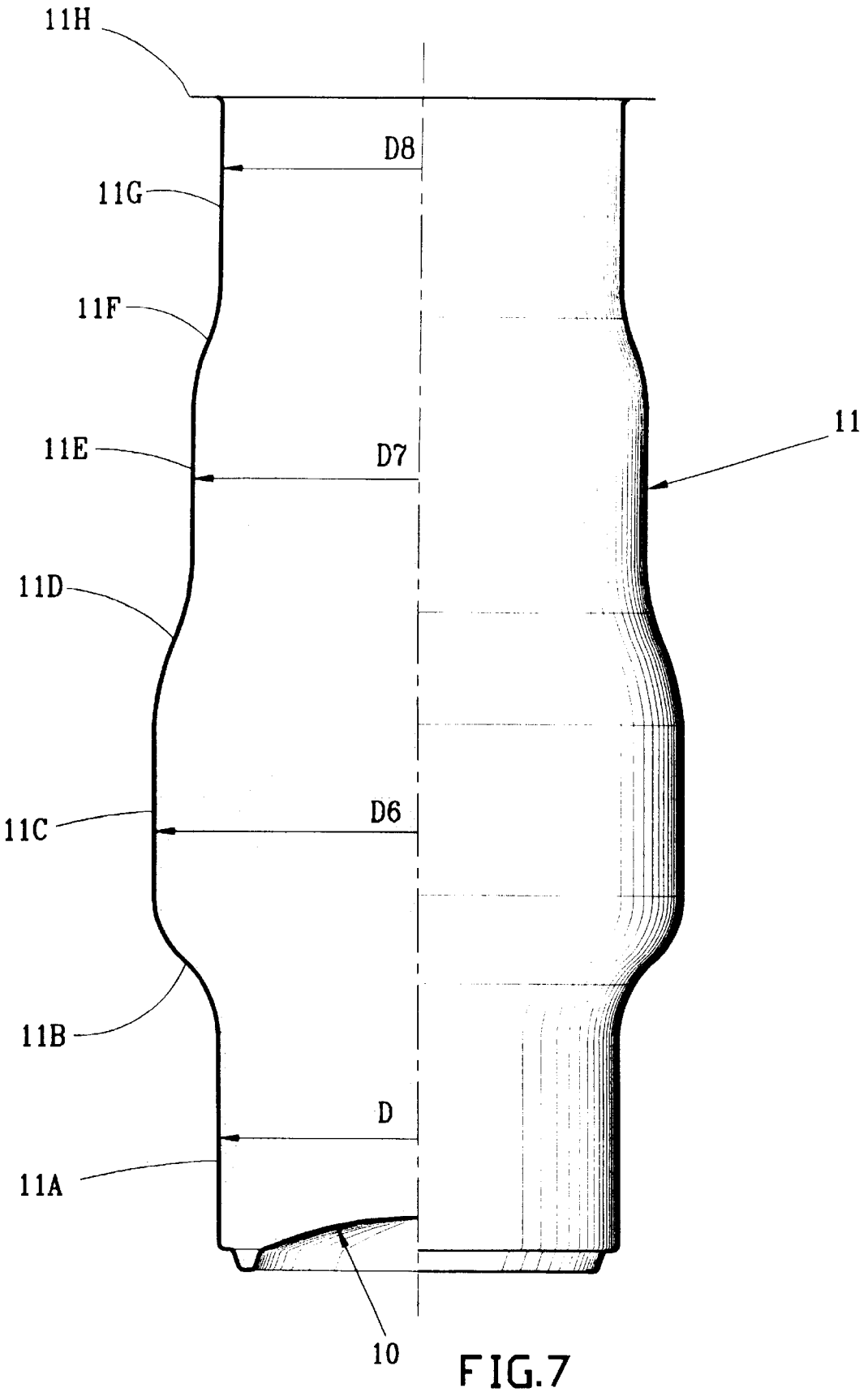
FIG. 7 is a longitudinal half-sectional and half-elevational view of a second embodiment of a shaped can obtained by the process according to the invention.

As shown in FIG. 7, the shaped can according to a second embodiment comprises a bottom 10 and a peripheral wall or skirt 11 in one piece with the bottom 10.

The peripheral wall 11 comprises a succession of regions of different diameters:

- a region 11A adjacent the bottom 10 and of diameter D,
- an intermediate portion 11B situated above and adjacent the region 11A in which the diameter of the peripheral wall 11 increases,
- a region 11C situated above and adjacent the intermediate portion 11B and of diameter D6 larger than the diameter D of the region 11A.
- an intermediate portion 11D situated above and adjacent the region 11C in which the diameter of the peripheral wall 11 decreases,
- a region 11E situated above and adjacent the intermediate portion 11D and of diameter D7 smaller than the diameter D6 of the region 11C and larger than the diameter D of the region 11A,
- an intermediate portion 11F situated above and adjacent the region 11E in which the diameter of the peripheral wall 11 decreases,
- a region 11G situated above and adjacent the intermediate portion 11F and of diameter D8 smaller than the diameter D7 of the region 11E,
- lastly, a region 11H corresponding to the flange for the crimping or seaming of a lid (not shown) after the can has been filled.

The feature of this can, as compared with the can shown in FIG. 1, is that the region 11C situated above and adjacent the region 11A adjacent the bottom 10 has a diameter D6 larger than the diameter D of the region 11A of the peripheral wall 11 of the shaped can.

The process according the invention for manufacturing this shaped can comprises, in a first step, producing for example by drawing and ironing a metal blank of steel, aluminium, or aluminium alloy, a cylindrical preliminary can having a diameter equal to the diameter D of the region 11A of the peripheral wall 11 adjacent the bottom 10, then, in a second step, effecting a necking operation on a part of the peripheral wall of the preliminary can so as to bring it to a given diameter smaller than the diameter D of the region 11A.

In such an embodiment, this diameter may be equal to the diameter of the region of the peripheral wall 11 of the formed can of the smallest diameter, namely the diameter D8 in FIG. 7.

When the region of the smallest diameter of the peripheral wall 11 of the formed can is the region 11A adjacent the bottom 10 of the can, the diameter D8 will be chosen to be smaller than this diameter D, since it is absolutely essential to start with a necking operation in order to be able to produce a shaped can with expansion ratios of higher than 1% from a preliminary can obtained for example from the drawing and ironing of a metal blank.

After having effected this necking step, the third step of the process according to the invention comprises effecting the expansion, in one or more operations, of the regions 11C and 11E of the peripheral wall of the preliminary can so as to impart the desired profile to each of these regions.

In this manner of proceeding, the first step comprises producing, by a drawing and ironing operation, a cylindrical preliminary can having a diameter equal to the diameter D.

In an alternative manner of proceeding, it is possible to produce in a first step, by a drawing operation or a drawing and ironing operation, a cylindrical preliminary can having a diameter equal to the diameter D6 corresponding to the region 11C of FIG. 7, and then to redraw this preliminary can so as to form the bottom and the region 11A of diameter D smaller than the diameter D6.

The second step comprising effecting the necking is in this case carried out on the region 11C of diameter D6.

To produce the shaped can shown in FIG. 1, it would also have been possible to carry out a second step, after the first step producing the preliminary can of diameter D by a drawing and ironing of a metal blank of steel, aluminium or aluminium alloy, which comprises effecting a necking operation on the part of the peripheral skirt of the preliminary can 3 situated above the region 2A of the peripheral wall 2 of the shaped can to bring it to the diameter of the region of the peripheral wall 2 of smallest diameter, namely to the diameter D5 of the region 2K.

After, an expanding operation comprising a plurality of successive expansions is carried out for obtaining the regions 2B and 2I.

The choice of one or the other of the aforementioned two manners of carrying out the process according the invention for producing the shaped can shown in FIG. 1 depends on the expanding method employed.

Indeed, if the expansion is effected my means of a die, i.e. according to the flaring method with a shaped punch, it is preferable to produce the can in the steps shown in FIGS. 2–6, i.e. by effecting a succession of expanding and necking operations.

On the other hand, if the expansion is effected by means of an incompressible fluid, it is preferable to effect a necking operation down to the minimum diameter, to form the neck when the can requires the presence of a neck, and then to effect the expansion of the various regions which need to be expanded.

When the expansion is effected by means of a tool having sectors, it is possible to employ indifferently either of the two alternative manners of proceeding.

As has been seen in these two embodiments of shaped cans, the important feature of the process according to the invention resides in the fact of commencing the forming of the preliminary can produced by a drawing and ironing by a necking operation.

Indeed, the Applicant has found that the prior necking facilitates the subsequent expansion of the peripheral wall, and enables for example steel having a very low carbon content which has been highly work hardened to accept expansion ratios with respect to the diameter of the preliminary can before necking which are higher than 2%, whereas if a direct expansion is effected without a prior necking, the expansion ratio remains below 1%.

This improved expansion capability of the can after a prior necking is due to the increase in the thickness of the peripheral wall resulting from this prior necking, and to the slight metallurgical and/or rheological transformations undergone by the metal during the necking operation.

Tests have been carried out on the bodies of cans having a diameter of 66 mm by varying the necking ratio of the first operation and thereafter effecting a maximum overall expansion.

The following table shows the results of these tests.

| Test No. | Diameter D1 after necking (in mm) | Necking Ratio 66 - D / 66 | Diameter D2 after expansion (in mm) | Expansion Ratio D2 - D1 / D1 |
|---|---|---|---|---|
| 1 | 66 | 0% | 66.74 | 1.12% |
| 2 | 63.79 | 3.35% | 67.34 | 5.56% |
| 3 | 62.55 | 5.23% | 66.64 | 6.54% |
| 4 | 61.30 | 7.12% | 66.33 | 8.20% |
| 5 | 60.06 | 9% | 66.28 | 10.36% |
| 6 | 58.81 | 10.89% | 65.83 | 11.94% |

As can be seen in this table, the fact of effecting a prior necking with a necking ratio of 3.35% (test 2) permits expanding the diameter up to 67.34 mm, which is larger than the diameter 66.74 mm reached with a direct expansion without a prior necking (test 1).

Further, if the two diameters D1 and D2 are compared, it is found that in test No. 1 the maximum possible variation is limited to 1.12% whereas in test No. 2 it is 5.56%.

It will also be clear from this table that, if the necking ratio of the first operation increases beyond about 5%, it is no longer possible to exceed the diameter D2 obtained with test No. 1, i.e. without a prior necking operation.

But, effecting a prior necking operation with a necking ratio higher than 5% has the advantage of the possibility of producing shaped cans with very pronounced bulges or curves.

Indeed, if test No. 2 is compared with test No. 6, it is in fact found that the final diameter after expansion is only 65.83 mm, namely less than the 67.34 mm of test No. 1 and even less than the 66 mm of the initial can body, but the overall expansion ratio between the necked region of diameter D1 and the expanded region of diameter D2 reaches 11.94% in test No. 6 as against 5.56% in test No. 2.

Thus it is found that an increase in the initial necking ratio results in an increase in the differences in diameter between the diameter after necking and the diameter after expansion.

The process for manufacturing shaped cans according the invention permits producing shaped cans with more pronounced bulges or curves and this process is easy to carry out industrially since the tools for effecting the necking and expanding operations are of known type and are employed by metal packing manufacturers.

The process according to the invention is not intended to be limited to drawn and ironed cans and may also be applied in the making of shaped cans from a preliminary can produced by drawing and redrawing a metal blank of steel, aluminium, or aluminium alloy.

In this case, the expansion ratio increases from 3% to about 6%.

What is claimed is:

1. Process for manufacturing a shaped metal beverage can comprising a bottom and a peripheral wall which includes a succession of regions of different diameters, said peripheral wall being adapted to receive a lid set on said peripheral wall, said process comprising the following steps:

producing from a metal blank a cylindrical preliminary can comprising a bottom and a peripheral wall which has a diameter equal to a given diameter of a region of said peripheral wall of said shaped can;

effecting an operation reducing the diameter of the peripheral wall by shrinking a part of said peripheral wall of said preliminary can situated above said region of said given diameter of said peripheral wall to bring said part to a diameter which is smaller than said given diameter;

and effecting at least one expanding operation on a part of said peripheral wall situated above said region of said given diameter for producing said succession of regions of different diameters of said peripheral wall.

2. Process according to claim 1, comprising, after having effected said operation reducing the diameter of said part of said peripheral wall by shrinking, effecting a single expanding operation for producing said succession of regions of different diameters of said peripheral wall.

3. Process according to claim 1, wherein the diameter of said part of said peripheral wall of said preliminary can situated above said region of said given diameter is equal to the diameter of the region of said peripheral wall of the shaped can of the smallest diameter.

4. Process according to claim 2, wherein the diameter of said part of said peripheral wall of said preliminary can situated above said region of said given diameter is equal to the diameter of the region of said peripheral wall of the shaped can of the smallest diameter.

5. Process according to claim 1, comprising, after having effected said operation reducing the diameter of said part of said peripheral wall by shrinking, effecting a succession of expanding and necking operations on the whole of the part of said peripheral wall of said preliminary can situated above a previously necked region.

6. Process according to claim 1, comprising, after having effected said operation reducing the diameter of said part of said peripheral wall by shrinking, effecting a succession of expanding and necking operations on the whole of the part of said peripheral wall of said preliminary can situated above the previously expanded region.

7. Process according to claim 1, comprising producing said preliminary can by drawing and ironing a blank of a metal selected from the group comprising steel, alluminium and alluminium alloy.

8. Process according to claim 1, comprising producing said preliminary can by drawing and redrawing a blank of a metal selected from the group comprising steel, alluminium and alluminium alloy.

9. The process of claim 7, wherein the metal is steel.

10. The process of claim 8, wherein the metal is steel.

11. The process of claim 7, wherein the diameter of said part of said peripheral wall is reduced by greater than 2%.

12. The process of claim 8, wherein the diameter of said part of said peripheral wall is reduced by greater than 2%.

13. The process of claim 9, wherein the diameter of said part of said peripheral wall is reduced by greater than 2%.

14. The process of claim 10, wherein the diameter of said part of said peripheral wall is reduced by greater than 2%.

* * * * *